US005706921A

United States Patent [19]

Wang

[11] Patent Number: 5,706,921

[45] Date of Patent: Jan. 13, 1998

[54] RETRACTABLE HANDLE ASSEMBLY FOR A SUITCASE

[76] Inventor: Jin-jiao Wang, No. 18, Lane 116, Ta An Gan Rd., Tachia Chen, Taichung Hsien, Taiwan

[21] Appl. No.: 759,740

[22] Filed: Dec. 3, 1996

Related U.S. Application Data

[63] Continuation-in-part of Ser. No. 695,693, Aug. 12, 1996.

[51] Int. Cl.[6] ..... A45C 5/14; A45C 13/26

[52] U.S. Cl. ..... 190/115; 190/18 A; 190/39; 16/112; 16/115

[58] Field of Search ..... 16/112, 115; 190/39, 190/115–117, 18 R; 280/37, 655, 655.1

[56] References Cited

U.S. PATENT DOCUMENTS

| | | | |
|---|---|---|---|
| 2,091,495 | 8/1937 | Steen | 16/112 |
| 5,323,887 | 6/1994 | Scicluna et al. | 190/115 X |
| 5,330,037 | 7/1994 | Wang | 190/115 X |
| 5,464,081 | 11/1995 | Zwanzig | 190/115 |
| 5,469,945 | 11/1995 | Tserng | 190/115 |
| 5,491,872 | 2/1996 | Tserng | 190/115 X |
| 5,497,865 | 3/1996 | Yun-Pi | 190/115 |
| 5,515,576 | 5/1996 | Tsai | 280/655 X |
| 5,526,908 | 6/1996 | Wang | 190/115 |

*Primary Examiner*—Sue A. Weaver
*Attorney, Agent, or Firm*—Martin Korn

[57] ABSTRACT

A handle assembly includes a supporting bracket fixedly mounted on a top wall of a suitcase and including a base plate having two end portions each with a socket defined therein, and a side extension wall extending downwardly from one side of the base plate. Two receiving casings are each fixedly mounted on the side extension wall and each communicate with a corresponding socket. Two catches each formed on the side extension are each located in a corresponding casing. Two rotary drums are each rotatably received in a corresponding receiving casing and each have a plurality of teeth formed on an outer periphery thereof and each meshing with an associated catch.

2 Claims, 9 Drawing Sheets

RETRACTABLE HANDLE ASSEMBLY FOR A SUITCASE

RELATED APPLICATION

The present invention is a continuation-in-part application of the applicant's U.S. Ser. No. 08/695,693, filed on Aug. 12, 1996, now pending.

FIELD OF THE INVENTION

The present invention relates to a retractable handle assembly for a suitcase.

BACKGROUND OF THE INVENTION

A conventional handle assembly for a suitcase comprises two retractable handles slidably mounted on the suitcase and a cross handgrip mounted between the two retractable handles for facilitating a user's hands to hold the cross handgrip.

By such an arrangement, however, the handgrip has a determined length without any retractability such that it is unsuitable for users of different heights, thereby limiting the usage of the handle assembly.

In addition, the two retractable handles are limited to slide in the suitcase only and cannot not be pivoted relative to the suitcase, that is, an included angle defined between each of the two handles and the suitcase is fixed constant and cannot be adjusted, thereby greatly limiting the adjustability of the handle assembly.

The present invention has arisen to mitigate and/or obviate disadvantages of the conventional handle assembly.

SUMMARY OF THE INVENTION

In accordance with one aspect of the present invention, there is provided a retractable handle assembly for a suitcase and the like. The handle assembly comprises a supporting bracket fixedly mounted on a top wall of the suitcase and including a base plate having two end portions each with a socket defined therein, and a side extension wall extending downwardly from one side of the base plate.

Two receiving casings are each fixedly mounted on the side extension wall and each communicate with an associated socket. Two catches are each formed on the side extension wall and are each located in a corresponding casing.

Two rotary drums are each rotatably received in a corresponding receiving casing and each have a passage radially defined therein and aligning with an associated socket. Each of the two rotary drums has a plurality of teeth formed on an outer periphery thereof and each meshing with an associated catch.

A substantially inverted U-shaped handle includes two legs, each leg movably mounted on the supporting bracket and each slidably extending through a corresponding socket and an associated passage.

Further features of the present invention will become apparent from a careful reading of the detailed description provided hereinbelow, with appropriate reference to the accompanying drawings.

DETAILED DESCRIPTION OF THE PREFERRED EMBODIMENTS

Figure 1:
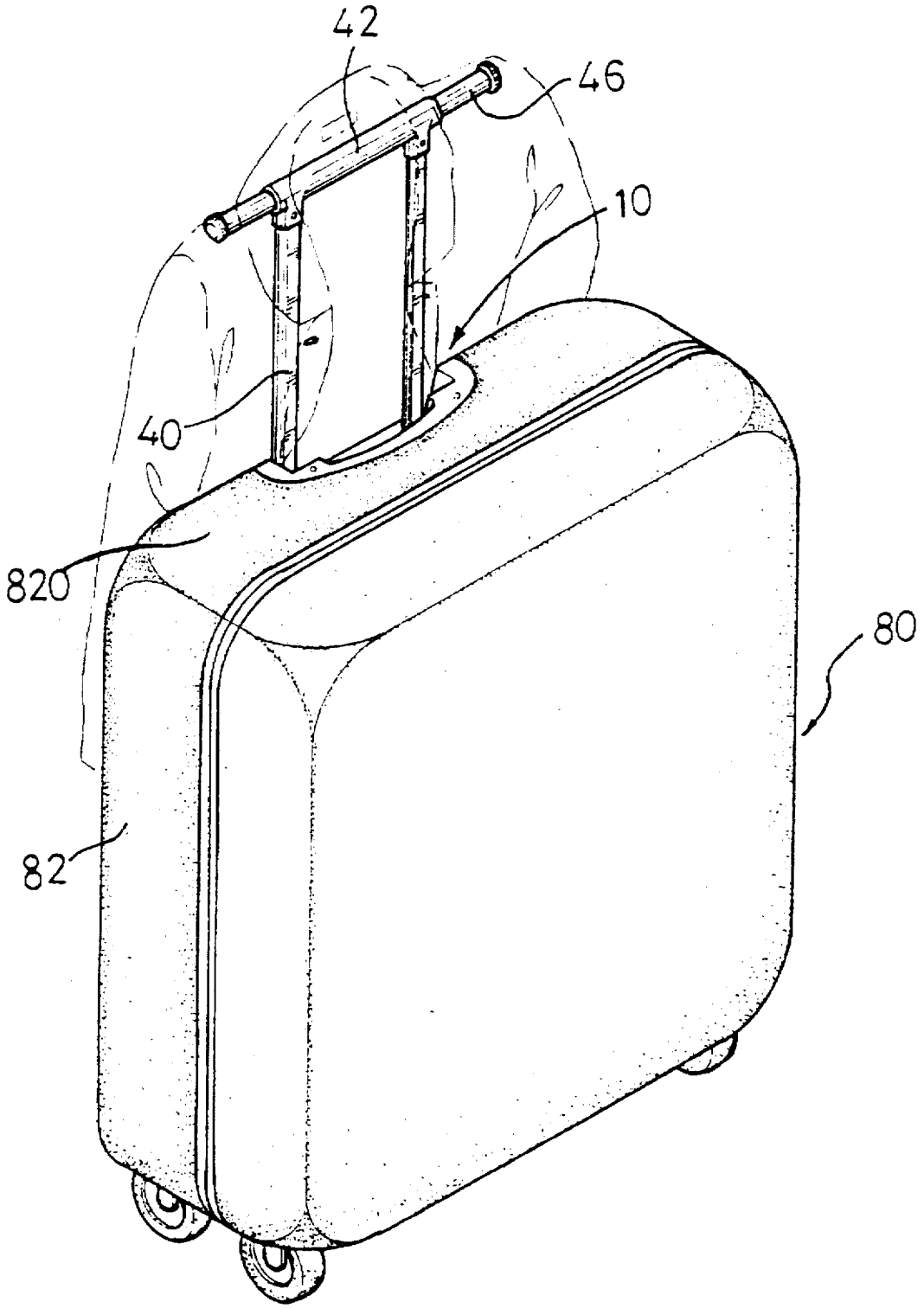
FIG. 1 is a front perspective view of a suitcase in accordance with the present invention.

Referring to the drawings, and initially to FIGS. 1–4, a retractable handle assembly in accordance with the present invention is provided for a suitcase 80 comprising two half bodies 82 engageable with each other and each having a top wall 820.

The handle assembly comprises a supporting bracket 10 fixedly mounted on the top wall 820 of one of the half bodies 82 of the suitcase 80 and including a base plate 100 having two end portions each with a socket 12 vertically defined therein, and a side extension wall 102 extending downwardly from one side of the base plate 100. The base plate 100 has a slot 101 defined in a mediate portion thereof.

Two receiving casings 16 are each fixedly mounted on the side extension wall 102 of the supporting bracket 10 and each communicate with a respective one of the two sockets 12. Two catches 18 are each formed on the side extension wall 102 of the supporting bracket 10 and are each located in a corresponding one of the two casings 16.

A retaining plate 15 is fixedly mounted on the side extension wall 102 between the two receiving casings 16 and located under the base plate 100.

Two rotary drums 30 are each rotatably received in a corresponding one of the two receiving casings 16 and each have a passage 32 radially defined therein and aligning with an associated socket 12. Each of the two rotary drums 30 has a plurality of teeth 36 formed on an outer periphery thereof and each detachably meshing with an associated catch 18.

A substantially inverted U-shaped handle includes two legs 40 each movably mounted on the supporting bracket 10 and each slidably extending through a corresponding one of the two sockets 12 and an associated passage 32. A handgrip 42 has two distal ends each having a sleeve 43 extending downwardly therefrom and fixedly mounted on an upper end of a corresponding one of the two legs 40.

Each of the two receiving casings 16 has a first semicircular cavity 162 defined therein. A receiving cap 20 has two end portions each fixedly mounted on a corresponding one of the two receiving casings 16 and each having a second semi-circular cavity 202 defined therein and aligning with an associated first semi-circular cavity 162.

Each of the two rotary drums 30 includes a first end face having a boss 34 protruding outwardly and received by associated first and second semi-circular cavities 162 and 202 and a second end face having a plurality of recesses 38 defined therein and arranged in an annular manner.

Figure 6:
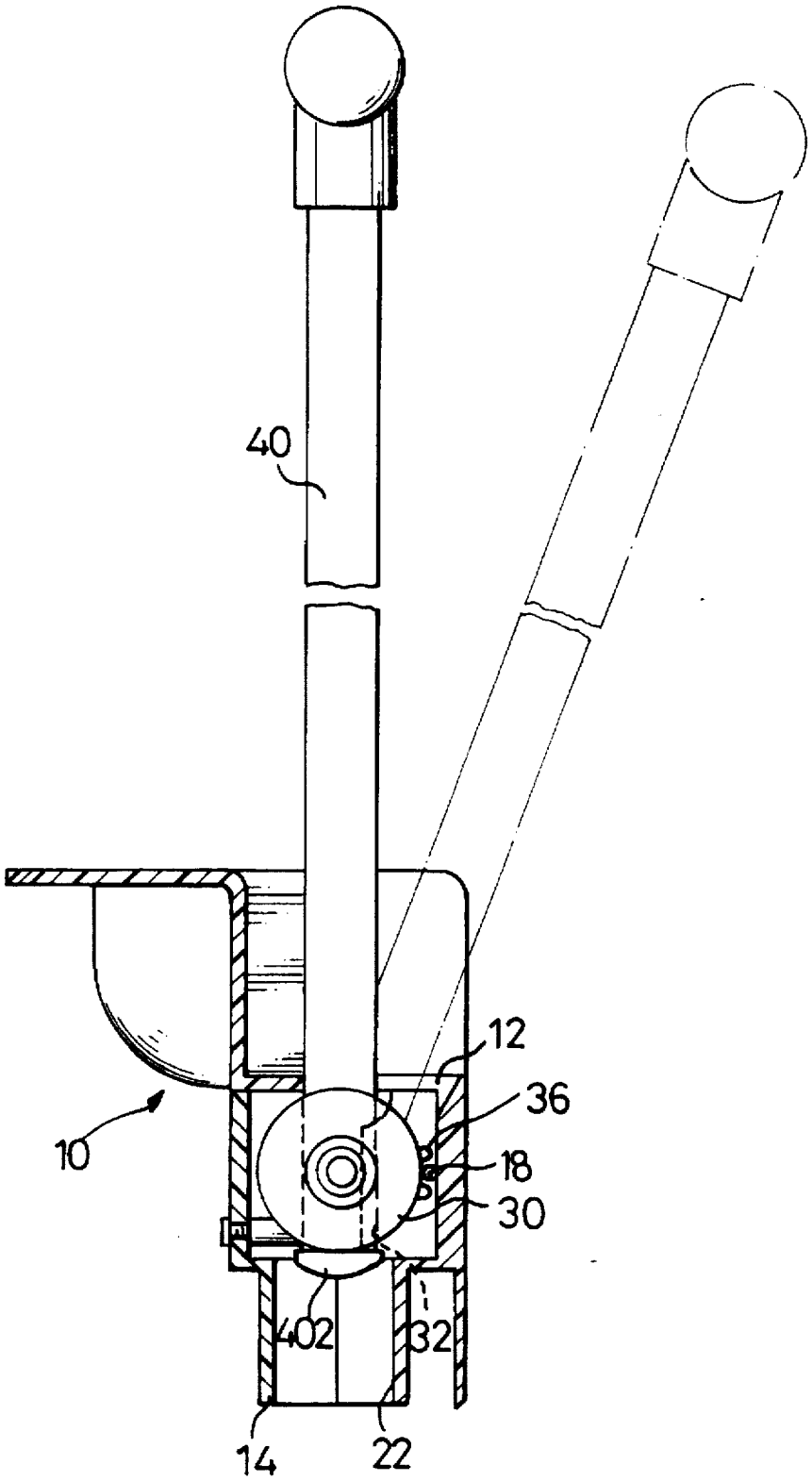
FIG. 6 is a side cross-sectional operational assembly view of FIG. 3.

Each of the two receiving casings 16 has a first half tube 14 extending downwardly and located under an associated rotary drum 30. Each end portion of the receiving cap 20 includes a second half tube 22 extending downwardly and engaged with an associated first half tube 14. Each of the two legs 40 has a lower portion with an enlarged stop 402 which can slide in an assembly of the first and second half tubes 14 and 22 and is stopped by an associated rotary drum 30 as best shown in FIG. 6.

Figure 3:
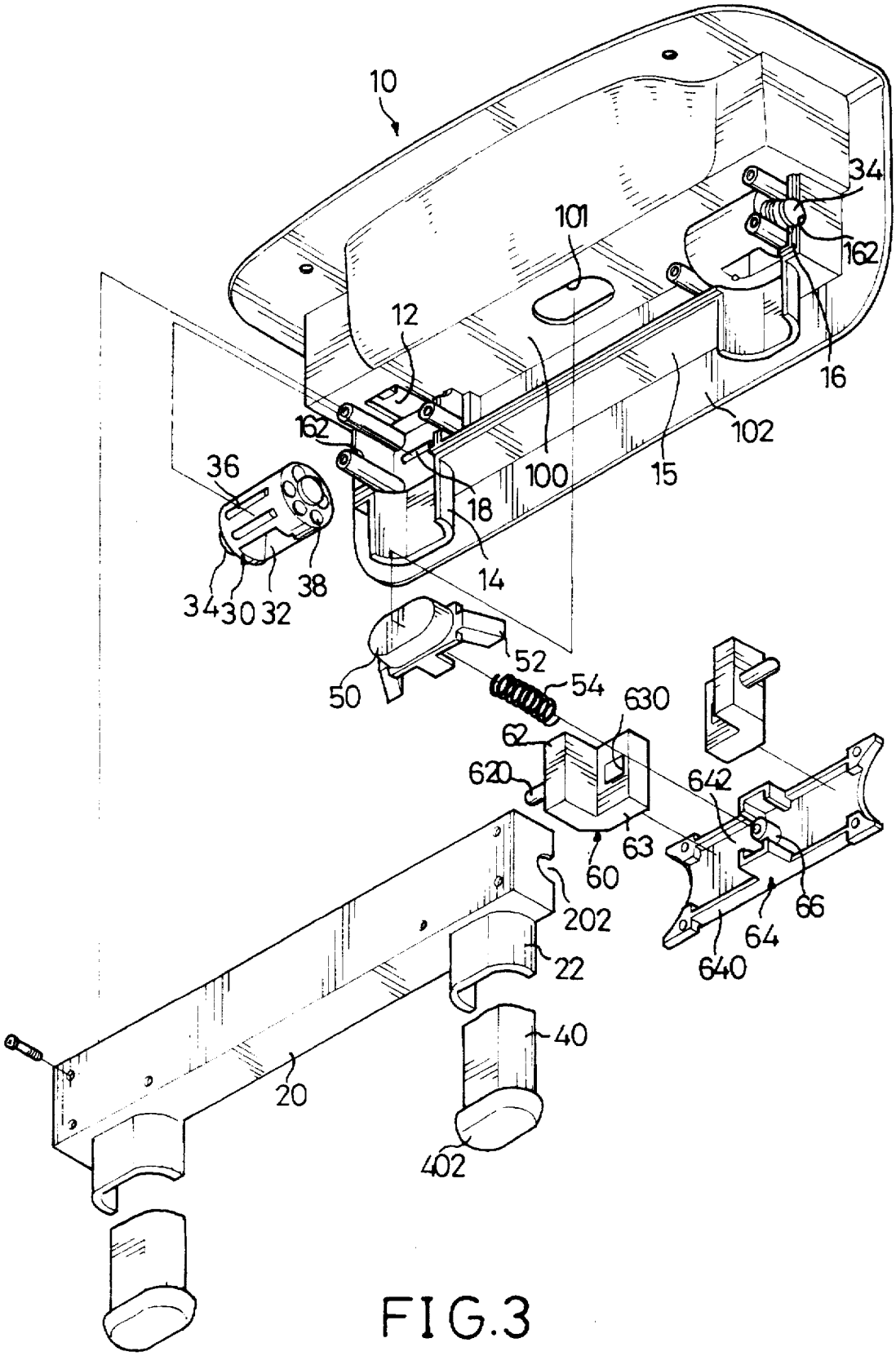
FIG. 3 is a bottom exploded view of FIG. 2.
Figure 4:
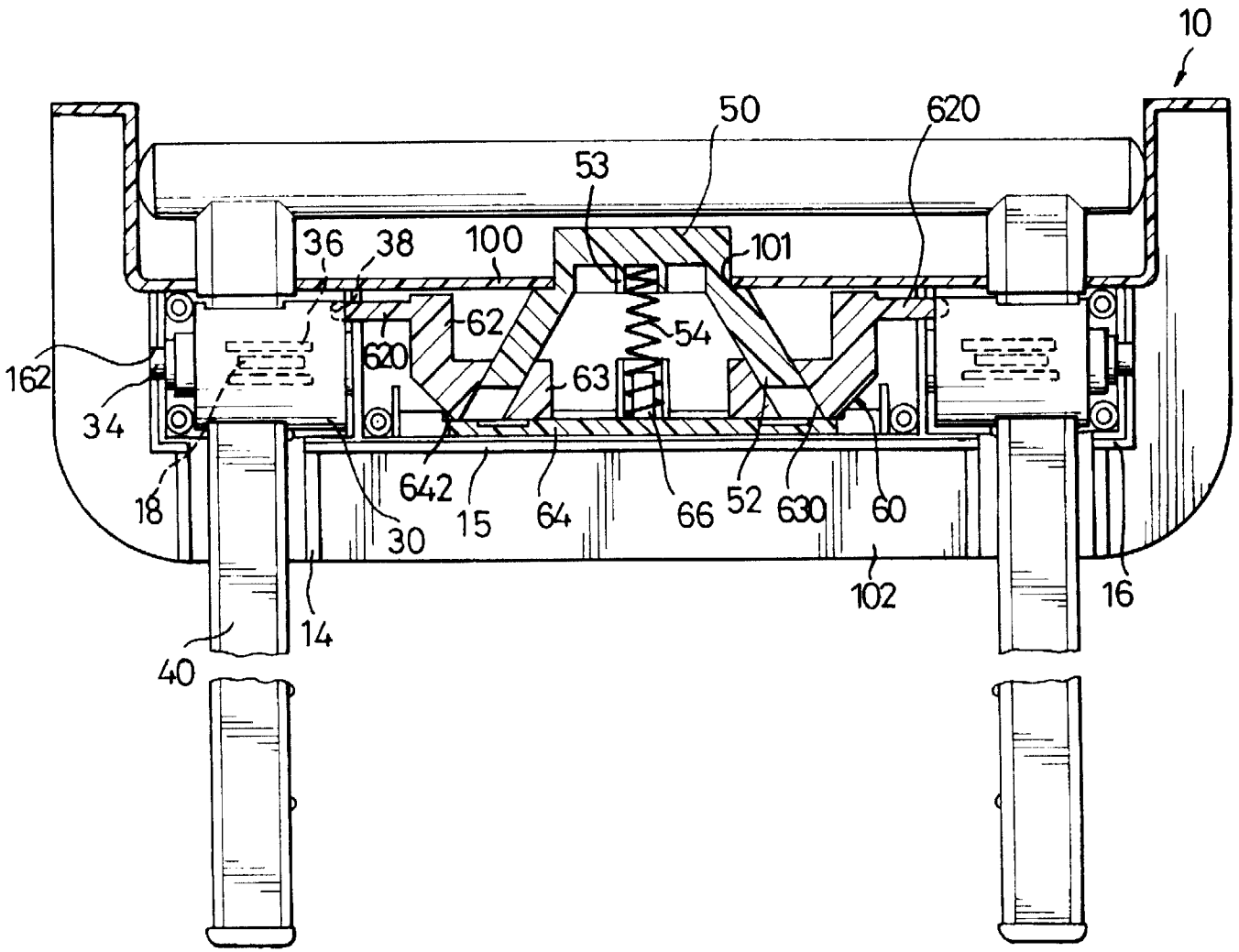
FIG. 4 is a cross-sectional assembly view of FIG. 3.

Referring to FIGS. 3 and 4, a supporting rack 64 is fixedly mounted on the retaining plate 15 and has two end portions 640 each having a guiding channel 642 defined therein.

Two substantially L-shaped sliding blocks 60 each include a horizontal section 63 slidably received in an associated guiding channel 642 of the supporting rack 64 and having an oblique chute 630 defined therein, and a vertical section 62 disposed adjacent to a corresponding rotary drum 30 and having a stub 620 horizontally extending outwardly and detachably engaged in an associated recess 38 of the rotary drum 30.

A pressing button 50 is slidably received in the slot 101 of the base plate 100 in a vertical manner and includes two end portions each having an oblique wedge 52 extending downwardly and outwardly and slidably received in an associated oblique chute 630.

A biasing member 54 is mounted between an underside of the pressing button 50 and the supporting rack 64.

The pressing button 50 has an annular lug 53 extending downwardly from the underside thereof, and the supporting rack 64 has a post 66 extending upwardly from a mediate portion thereof. The biasing member 54 has an upper portion received in the annular lug 53 and a lower portion mounted around the post 66.

Figure 5:
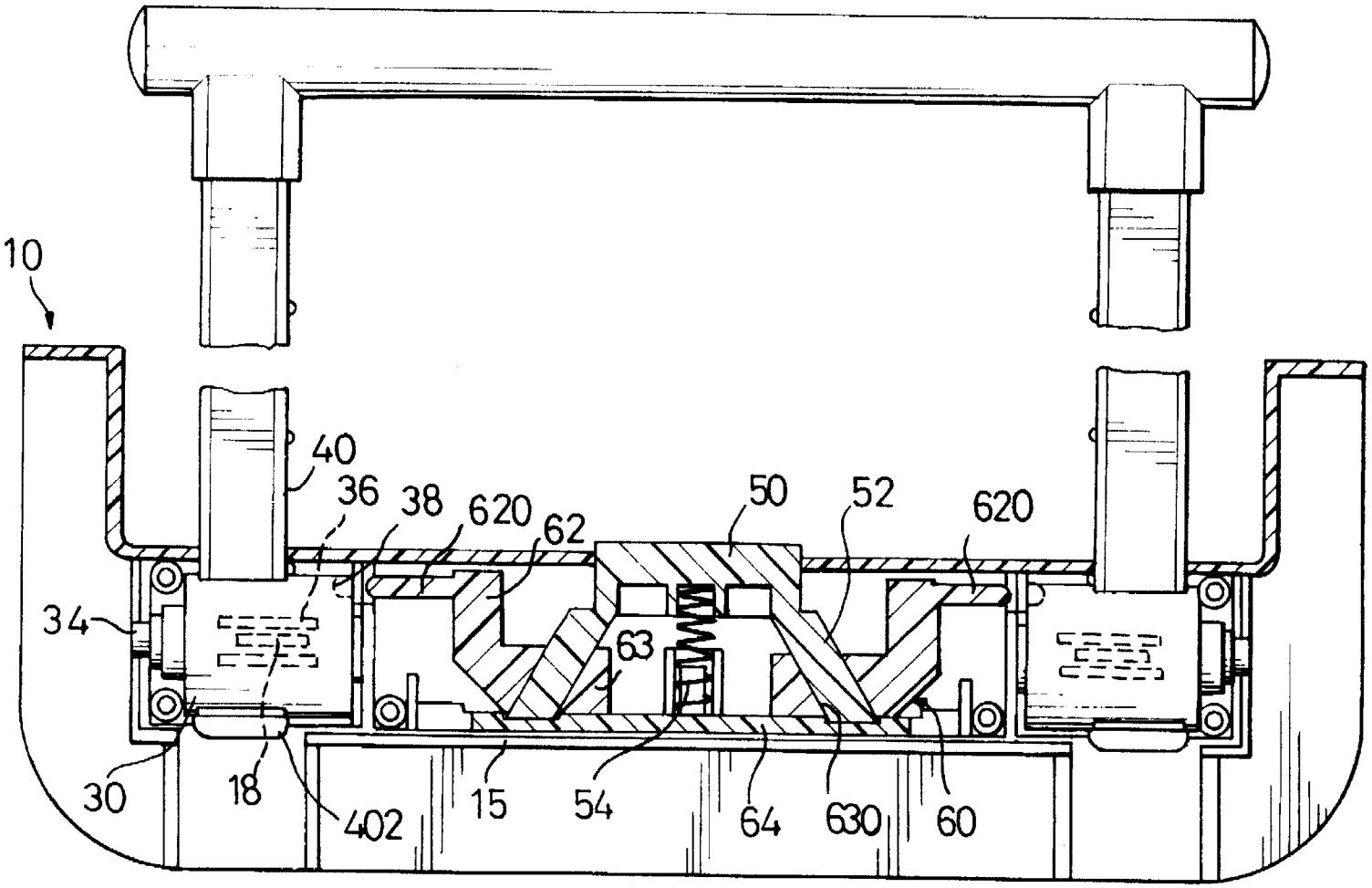
FIG. 5 is an operational view of FIG. 4.

In operation, referring to FIGS. 4–6 with reference to FIG. 3, each of the two legs 40 can slide in the socket 12 of the supporting bracket 10, the passage 32 of the rotary drum 30 and the assembly of the first and second half tubes 14 and 22.

When each of the two legs 40 is elevated to an uppermost position as shown in FIG. 6 with the enlarged stop 402 limited by the rotary drum 30, the pressing button 50 can be pressed downwardly, thereby moving the two sliding blocks 60 relative to each other by means of an engagement between each of the two oblique wedges 52 and the associated oblique chute 630 such that the two sliding blocks 60 can be displaced from a position as shown in FIG. 4 to a position as shown in FIG. 5, thereby detaching each of the two stubs 620 from the associated recess 38 of the rotary drum 30 such that each of the legs 40 together with the rotary drum 30 can be rotated relative to the supporting bracket 10 to a position as shown in phantom lines in FIG. 6.

At the same time, the rotational movement of the rotary drum 30 can be limited by means of a detachable engagement between the plurality of teeth 36 and the catch 18 as shown in FIG. 6, thereby providing a temporary positioning effect during the rotational movement of each of the legs 40 together with the associated rotary drum 30.

Figure 2:
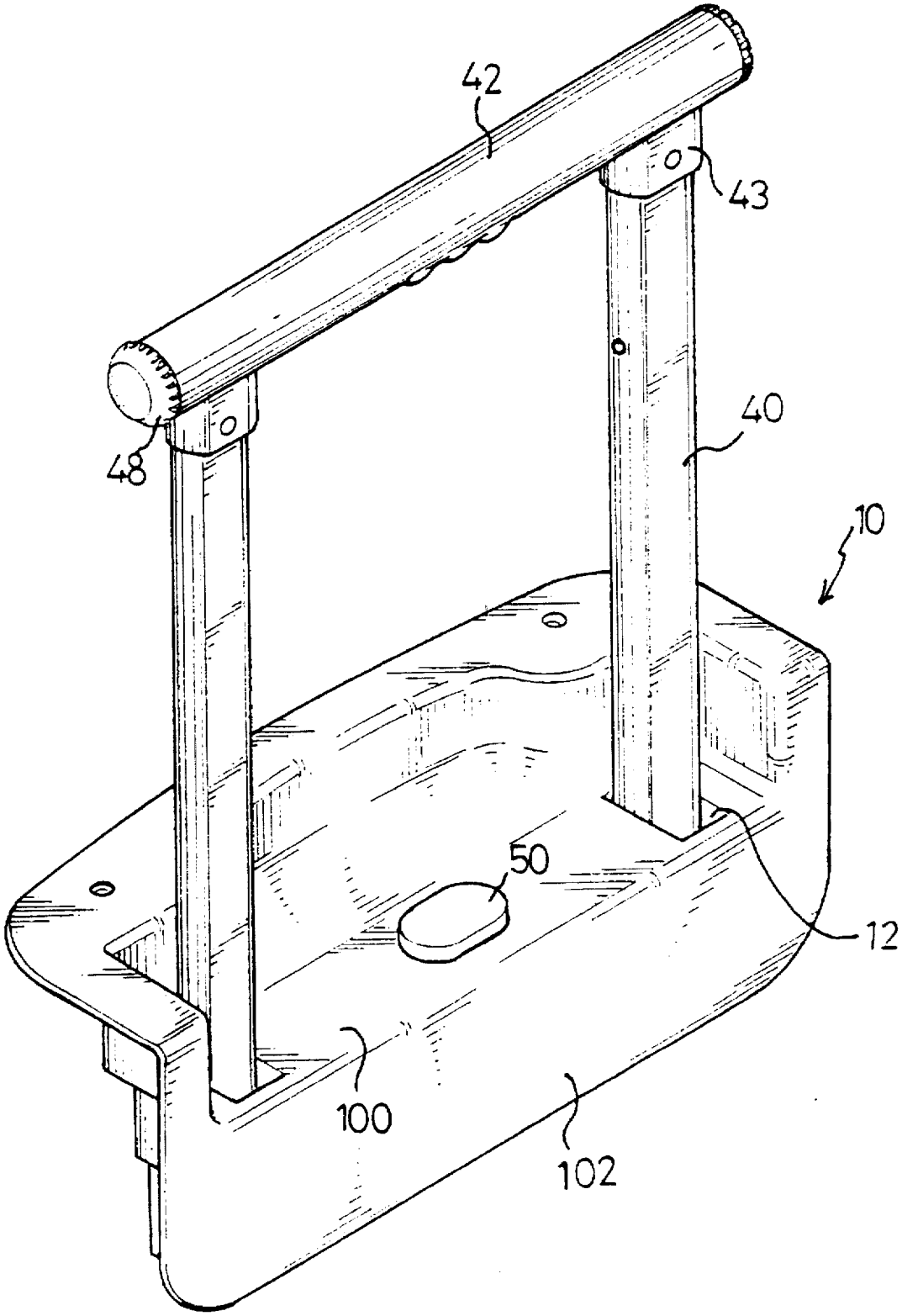
FIG. 2 is a rear perspective view of a retractable handle assembly in accordance with the present invention.
Figure 7:
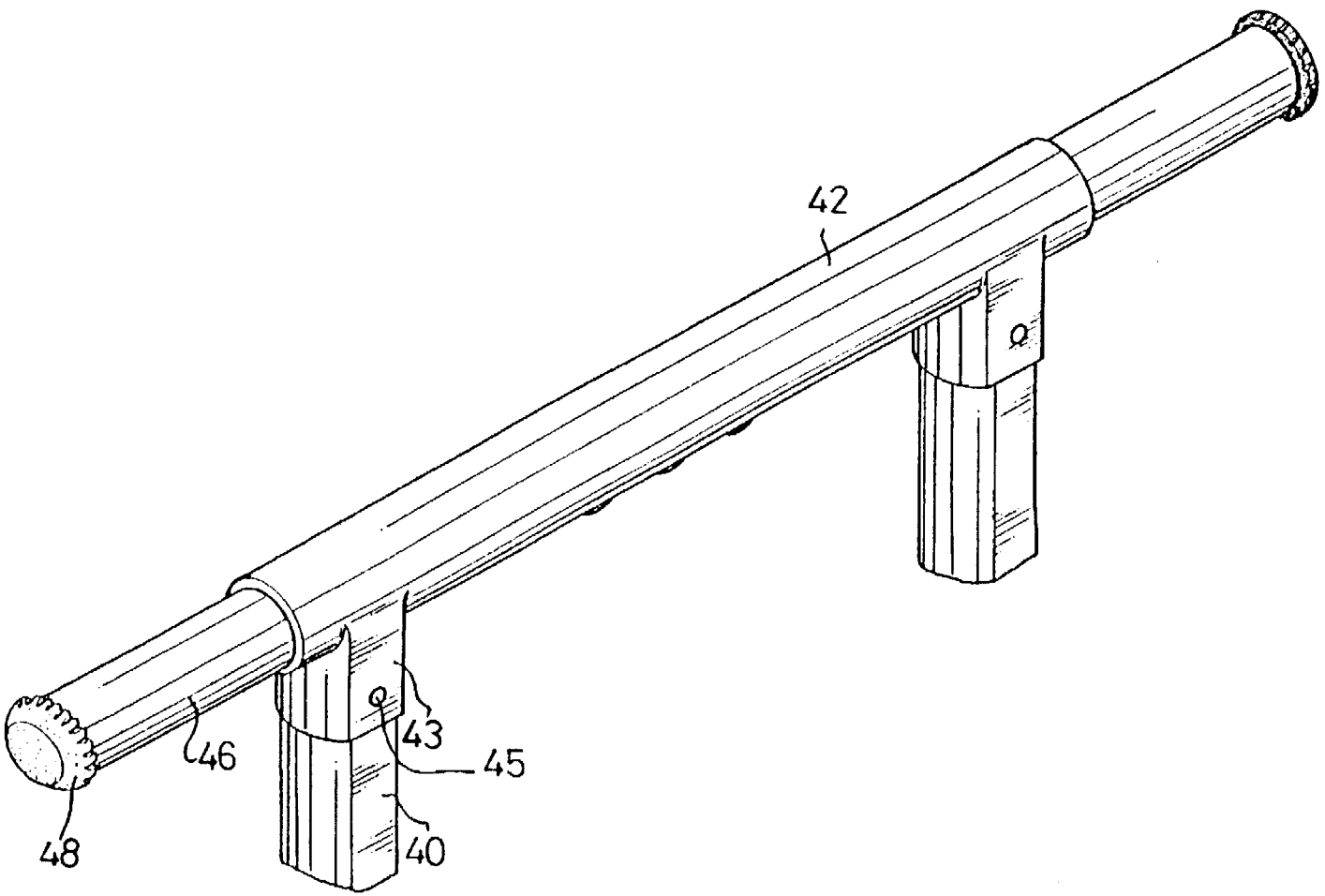
FIG. 7 is a perspective view showing an assembly of a handgrip, two handles and two retractable tubes.
Figure 8:
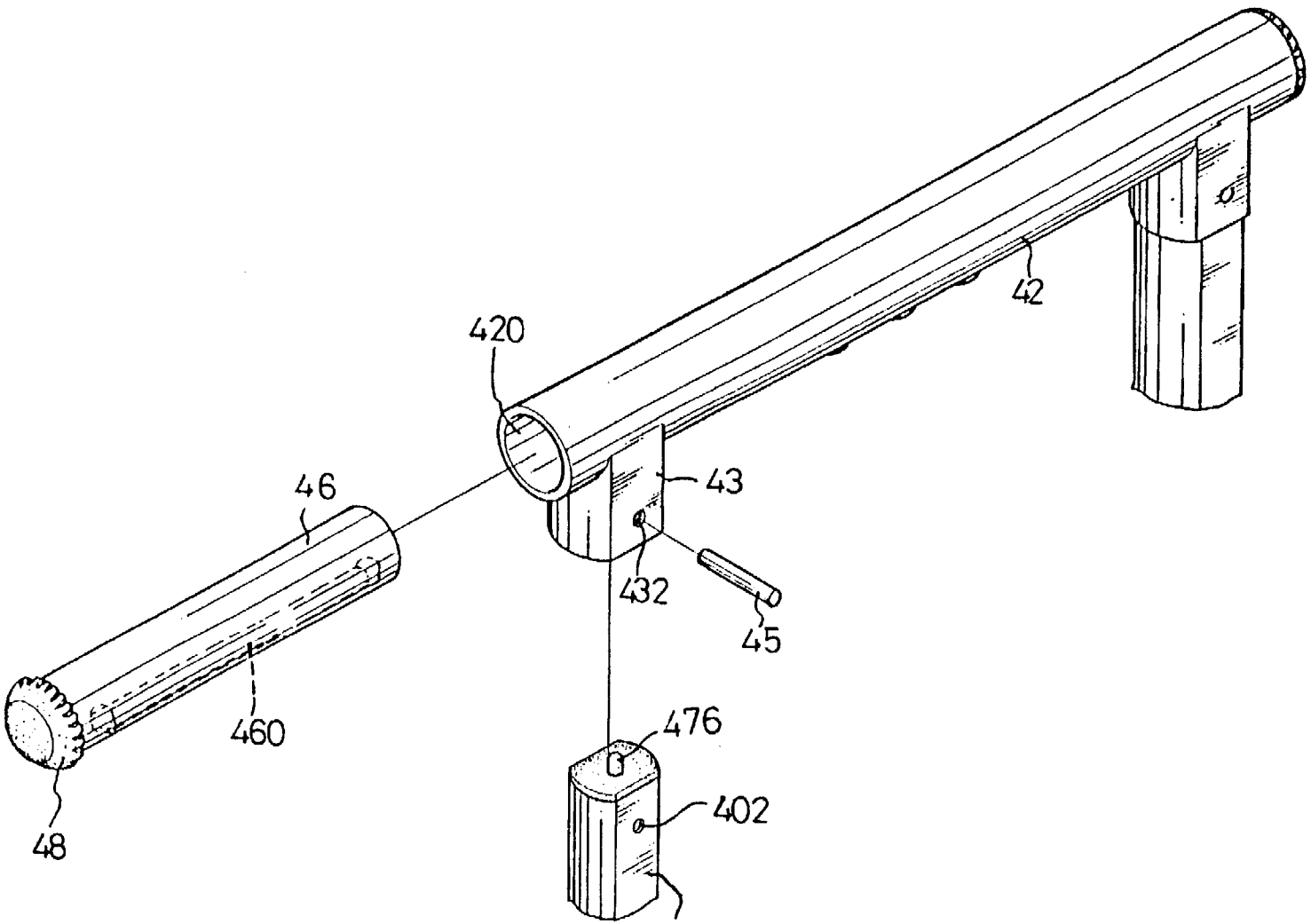
FIG. 8 is a partially exploded view of FIG. 7.
Figure 9:
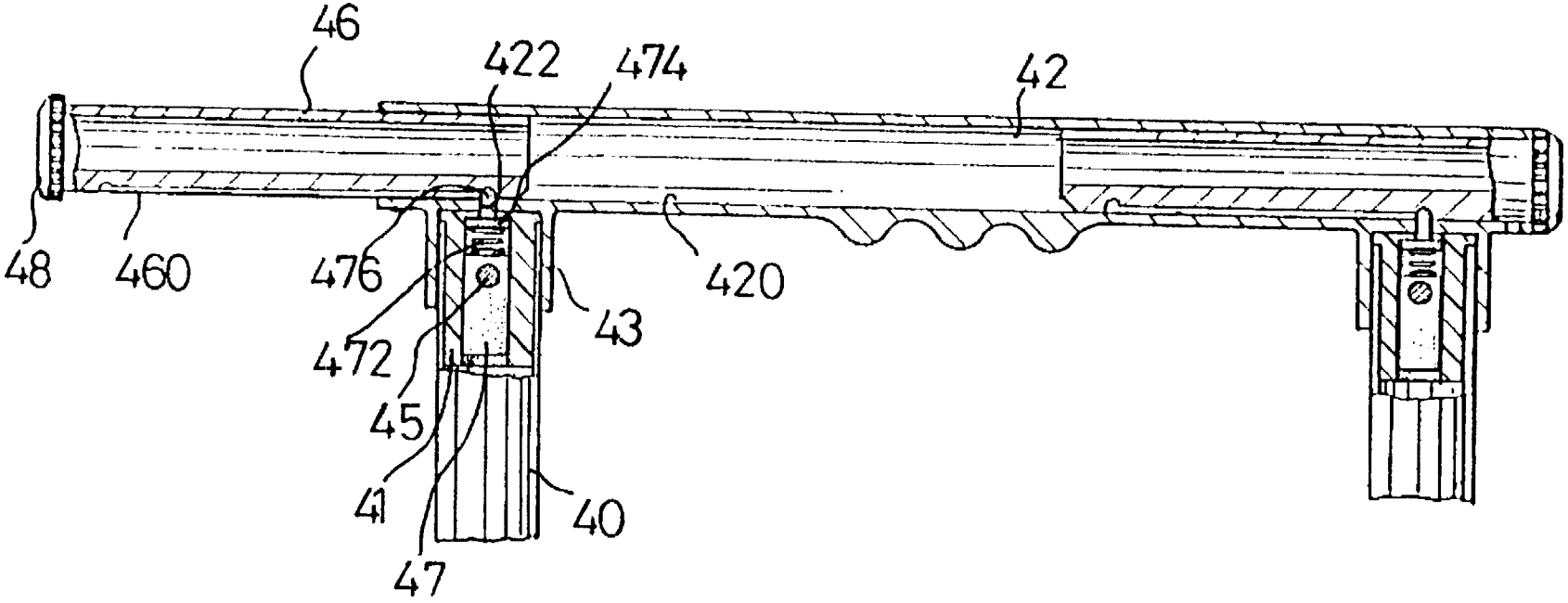
FIG. 9 is a front plan cross-sectional assembly view of FIG. 7.

Referring to FIGS. 7–9 with reference to FIG. 2, two retractable tubes 46 are each mounted on an associated end of the handgrip 42, each slidably received in a channel 420 longitudinally defined in the handgrip 42. Each of the retractable tubes 46 has an enlarged head 48 mounted on one distal end thereof and has an elongate slot 460 defined in an outer periphery thereof.

Two bushings 41 are each received in the upper end of an associated legs 40 and each have a packing 47 received therein.

Two positioning pins 45 each extend through a hole 432 defined in each of the sleeves 43, a hole 402 defined in the upper end of each of the legs 40, a hole (not shown) defined in each of the bushings 41, and a hole (not labeled) defined in each of the packings 47, thereby fixing the handgrip 42 on the two legs 40.

Two supporting pieces 474 are each slidably mounted in an associated bushing 41 and each have a boss 476 extending through a hole 422 defined in each of the two distal ends of the handgrip 42 and received in the elongate slot 460 of the retractable tube 46, thereby preventing each of the two retractable tubes 46 from escaping from the handgrip 42. Two biasing members 472 are each mounted between the supporting piece 474 and the packing It should be clear to those skilled in the art that further embodiments of the present invention may be made without departing from the spirit and scope of the present invention.

What is claimed is:

1. A handle assembly for a suitcase (80) having a top wall (820), said handle assembly comprising:

a supporting bracket (10) fixedly mounted on said top wall (820) of said suitcase (80) and including a base plate (100) having two end portions each with a socket (12) defined therein, and a side extension wall (102) extending downwardly from one side of said base plate (100), said base plate (100) having a slot (101) vertically defined in a mediate portion thereof;

two receiving casings (16) each fixedly mounted on said side extension wall (102) and each communicating with each of said two sockets (12), two catches (18) each formed on said side extension wall (102) and each located in a corresponding one of said two casings (16);

two rotary drums (30) each rotatably received in a corresponding one of said two receiving casings (16) and each having a passage (32) radially defined therein and aligning with an associated one of said sockets (12), each of said two rotary drums (30) having a plurality of teeth (36) formed on an outer periphery thereof and each meshing with an associated said catch (18), each of said two rotary, drums (30) having one end face defining a plurality of recesses (38) therein;

a retaining place (15) fixedly mounted on said side extension wall (102) between said two receiving casings (16) and located under said base plate (100);

a supporting rack (64) fixedly mounted on said retaining plate (15) and having two end portions (640) each defining a guiding channel (642) therein;

two substantially L-shaped sliding blocks (60) each including a horizontal section (63) slidably received in an associated guiding channel (642) of said supporting rack (64) and defining an oblique chute (630) therein, and a vertical section (62) disposed adjacent to a corresponding one of said two rotary, drums (30) and having a stub (620) horizontally extending outwardly and detachably engaged in an associated recess (38) of said rotary, drum (30);

a pressing button (50) slidably received in said slot (101) of said base plate (100) and including two end portions each having an oblique wedge (52) extending downwardly and outwardly and slidably received in said oblique chute (630) of an associated said sliding block (60);

a biasing member (54) mounted between an underside of said pressing button (50) and said supporting rack (64);

a substantially inverted U-shaped handle including two legs (40) each movably mounted on said supporting bracket (10) and each slidably extending through a corresponding one of said two sockets (12) and an associated said passage (32); and a handgrip (42) having two distal ends each having a sleeve (43) extending downwardly therefrom and fixedly mounted on an upper end of a corresponding one of said two legs (40).

2. The handle assembly in accordance with claim 1, wherein said pressing button (50) has an annular lug (53) extending downwardly from the underside thereof, said supporting rack (64) having a post (66) extending upwardly from a mediate portion thereof, and said biasing member having an upper portion received in said annular lug (53) and a lower portion mounted around said post (66).

* * * * *